United States Patent [19]

Ruseff

[11] 4,381,647

[45] May 3, 1983

[54] LOAD-PLUS VALVE FOR VARIABLE DISPLACEMENT PUMPS

[75] Inventor: Walter Z. Ruseff, New Lenox, Ill.

[73] Assignee: Caterpillar Tractor Co., Peoria, Ill.

[21] Appl. No.: 261,108

[22] Filed: Sep. 12, 1980

[51] Int. Cl.[3] ..... F16H 39/46

[52] U.S. Cl. ..... 60/452; 417/222

[58] Field of Search ..... 60/445–452; 417/212, 216–222

[56] References Cited

U.S. PATENT DOCUMENTS

| | | | |
|---|---|---|---|
| 3,350,881 | 1/1966 | D'Amato | 60/52 |
| 3,406,850 | 9/1965 | Hancox | 214/138 |
| 3,444,689 | 5/1969 | Budzich | 60/427 |
| 3,797,245 | 3/1974 | Hein | 60/452 |
| 3,809,501 | 5/1974 | Weisenbach | 417/222 |
| 4,013,381 | 3/1977 | Hein et al. | 417/222 |
| 4,034,564 | 7/1977 | Johnson et al. | 417/218 X |
| 4,074,529 | 2/1978 | Budzich | 60/445 |
| 4,116,587 | 9/1978 | Liesener | 417/212 |
| 4,124,333 | 11/1978 | Liesener | 417/218 |

*Primary Examiner*—Edward K. Look

*Attorney, Agent, or Firm*—Paul S. Lempio

[57] ABSTRACT

A "load-plus" valve is oftentimes utilized in the servo-system for a variable displacement pump to maintain pump discharge pressure above a minimum pressure level and above a load pressure in a fluid actuator. Valves of this type normally employ a spring interconnected between a modulating spool and a piston which is responsive to load pressure to modulate a control pressure, controlling the displacement of the pump. Valves of this type thus provide a constant discharge pressure margin over load pressure while also providing the pump's minimum stand-by pressure. However, valves of this type further provide pump packages which are somewhat bulky in design. The improved load-plus valve (22) of this invention provides a spool (49) movable between a first position communicating a control pressure ($P_C$) from a pump (11) to a control chamber (24) and a second position at least partially venting the control chamber (24), and a piston (57) movable between a first position isolating the piston (57) from the spool (49) to enable the spool (49) to move independently of the piston (57) and a second position engaging and moving the spool (49) to modulate the control pressure ($P_C$) in response to variations in a load pressure ($P_L$) in a fluid actuator (13).

10 Claims, 3 Drawing Figures

LOAD-PLUS VALVE FOR VARIABLE DISPLACEMENT PUMPS

DESCRIPTION

Technical Field

This invention relates generally to a load-plus valve for use in the servo-system of a variable displacement pump, and more particularly to a load-plus valve having a load piston normally isolated from a modulating spool and movable into contact therewith to control pump displacement.

Background Art

Variable displacement pumps are employed in the hydraulic control circuits of construction vehicles to control fluid actuators, such as double-acting hydraulic cylinders. The servo-systems employed for such pumps oftentimes include a flow-pressure compensated or "load-plus" valve which functions to maintain pump discharge pressure above a minimum pressure level and also above a load pressure generated in the cylinder. This type valve is fully disclosed in U.S. Pat. No. 4,116,587, issued on Sept. 26, 1978 to Kenneth P. Liesener and assigned to the assignee of this application.

The "load-plus" valve functions to sense load pressure and to automatically actuate a swash plate of the pump in response to such pressure to maintain a desired pump discharge pressure. The load pressure is received by a piston which controls the movements of a modulating spool through a relatively large compression coil spring. A second, smaller spring acting in conjunction with the larger spring establishes a margin pressure, whereas the larger spring establishes a stand-by pressure for the system. Since the piston must travel a substantial distance and due to the associated arrangement of the springs, substantial space for such components is required, resulting in a relatively large pump package. In addition, since the piston and spool are continually interconnected by the springs, the system remains continuously dynamic and close calibration of the springs is required to ensure the desired margin and stand-by pressures.

The present invention is directed to overcoming one or more of the problems as set forth above.

Disclosure of Invention

In one aspect of the present invention, a fluid circuit has a fluid actuator, a variable displacement pump including a control member, a first biasing means for urging the control member towards a first displacement position, a second biasing means for urging the control member towards a second displacement position in response to a variable control pressure, a first means for varying the control pressure in proportion to the discharge pressure of the pump, and a second means for controlling the first means to modulate the control pressure in response to variations in the load pressure.

The improved fluid circuit further comprises means (A) for isolating the second means from the first means freeing the first means to function independently of the second means in response to the load pressure falling below a pre-determined level, and (B) for interconnecting the first and second means to modulate the control pressure in response to the load pressure exceeding such predetermined level.

The improved fluid circuit will thus function efficiently to establish margin and stand-by pressures with the above first means, which may include a modulating valve spool, being enabled to establish a stand-by pressure independent of the second means which is responsive to load pressure. Such isolation improves the working efficiency of the system and provides for the utilization of a relatively small and compact pump package.

BRIEF DESCRIPTION OF THE DRAWINGS

Other objects and advantages of this invention will become apparent from the following description and accompanying drawings wherein.

Best Mode of Carrying Out the Invention

Figure 1:
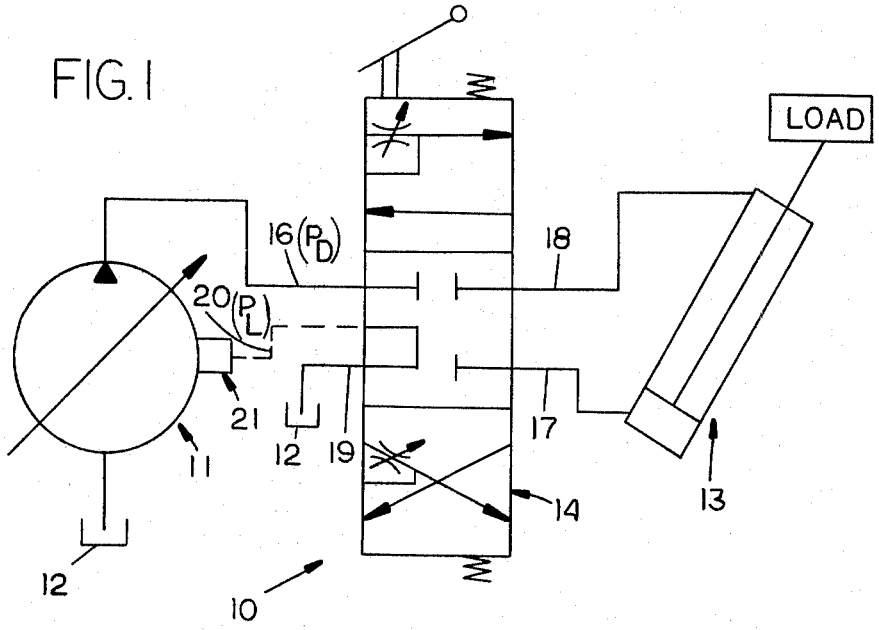
FIG. 1 schematically illustrates a fluid circuit employing an improved load-plus valve embodiment of the present invention therein for controlling the displacement of a variable displacement pump.

FIG. 1 illustrates a fluid circuit 10 comprising a variable displacement pump 11 for communicating pressurized fluid from a reservoir or tank 12 to a fluid actuator 13 under the control of a standard directional control valve 14. The engine-driven pump may take the form of a hydraulic pump of the type shown in FIG. 2 of the drawings. In the illustrated fluid circuit, actuator 13 constitutes a double-acting hydraulic cylinder adapted for use on a construction vehicle or the like in a conventional manner.

Upon upward movement of directional control valve 14 in FIG. 1, the head end of cylinder 13 will be pressurized via lines 16 and 17, whereas the rod end thereof will be vented to tank 12 via lines 18 and 19. Downward shifting of directional control valve 14 will pressurize the rod end of cylinder 13 via lines 16 and 18 and exhaust the head end of the cylinder via lines 17 and 19. When either the head or rod end of cylinder 13 is pressurized with hydraulic fluid, a line 20 will communicate a load pressure signal $P_L$ to a servo-system 21 for pump 11.

Figure 3:
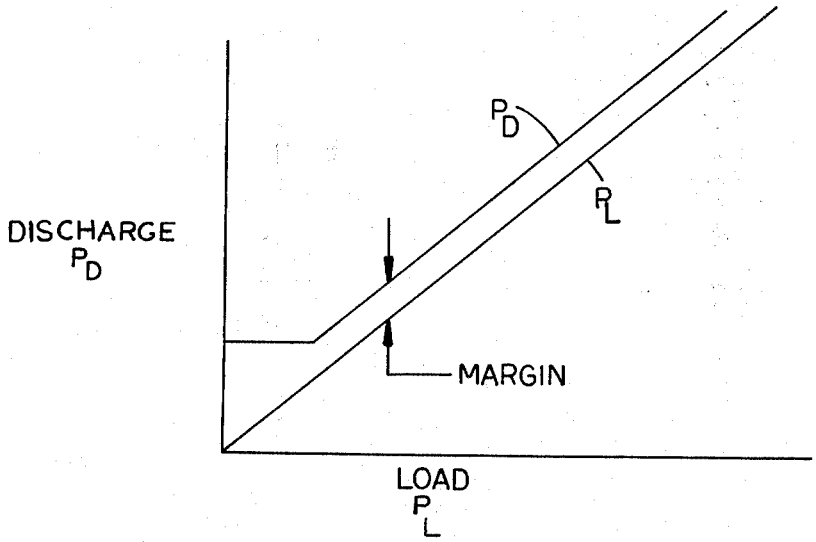
FIG. 3 graphically illustrates a margin pressure between a pump discharge pressure $P_D$ and a load pressure $P_L$ generated in a fluid actuator while maintaining a different standby pressure.
Figure 2:
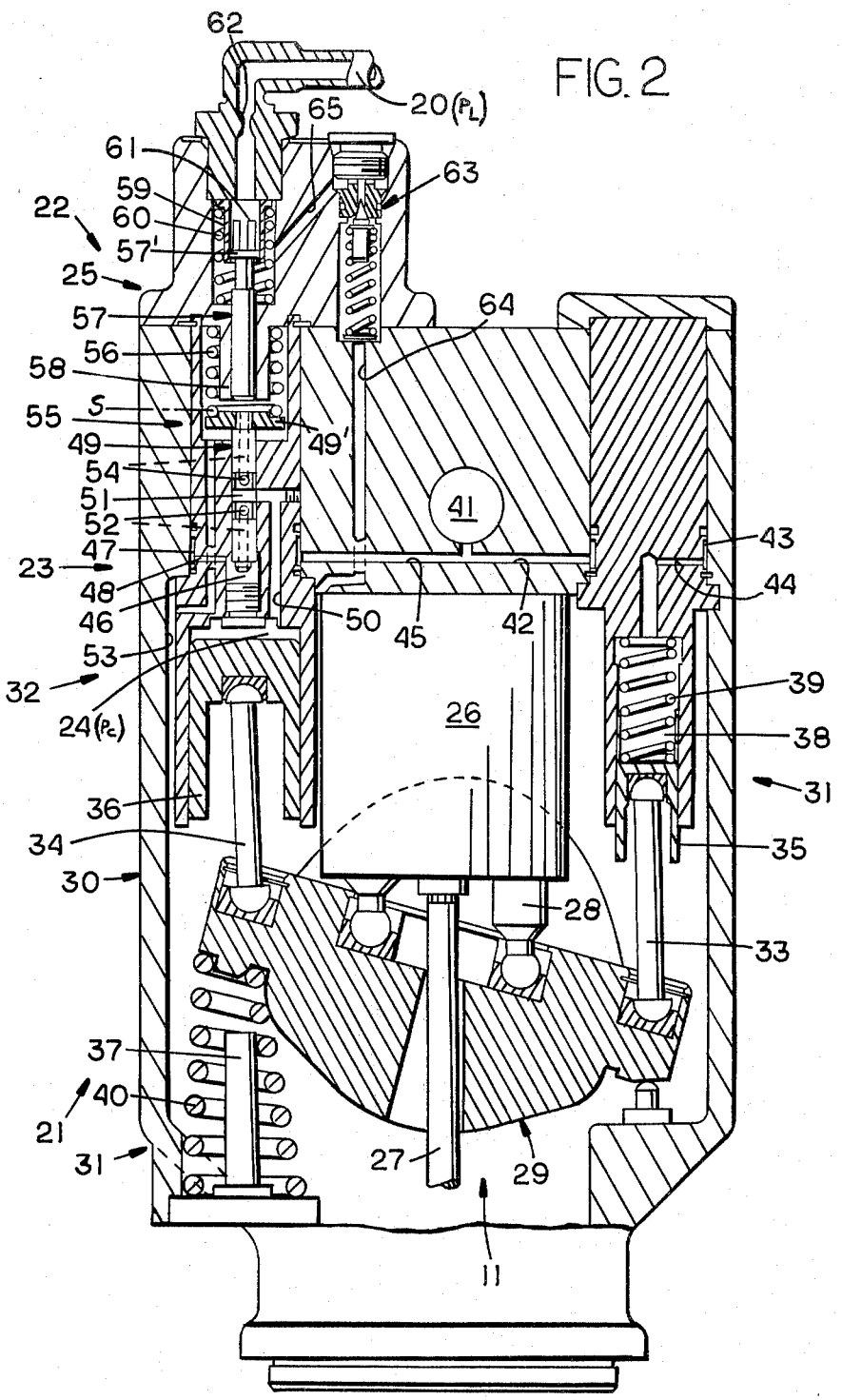
FIG. 2 is a longitudinal sectional view illustrating the load-plus valve and associated pump.

Referring to FIG. 2. servo-system 21 includes a flow-pressure compensated or "load-plus" valve 22 for maintaining pump discharge pressure $P_D$ in line 16 at a predetermined level above the required load pressure $P_L$ in line 20 and the active line 17 or 18, as depicted by the "MARGIN" in FIG. 3. As described more fully hereinafter, load-plus valve 22 includes first means 23 for varying a control pressure $P_C$ in a control or actuating chamber 24 in proportion to discharge pressure $P_D$ of pump 11, and second means 25 for controlling the first means to modulate the control pressure $P_C$ in response to variations in load pressure $P_L$.

As shown in FIG. 2, hydraulic pump 11 comprises a barrel 26 adapted to be driven by an output shaft 27 of an engine, a plurality of reciprocal pistons 28 connected to a control member or swash plate 29, and a housing 30 enclosing the pump assembly. The displacement of pump 11 is determined by the rotational orientation of swash plate 29, having opposite sides thereof connected to first and second biasing means 31 and 32 which are interrelated by rods 33 and 34 and pistons 35 and 36. In the position illustrated, swash plate 29 will effect maximum pump displacement, whereas horizontal orientation of the swash plate in FIG. 2 will effect zero or minimum displacement of the pump upon engagement of the swash plate with a stop 37.

First biasing means 31 may be considered to comprise the fluid pressure communicated to an actuating chamber 38 above piston 35, a first compression coil spring 39 mounted in the chamber and disposed between housing 30 and the piston, and a second compression coil spring 40 mounted between swash plate 29 and housing 30. Second biasing means 32 may be considered to comprise the control pressure $P_C$ prevalent in chamber 24, above piston 36 which has a substantially larger effective diameter than piston 35. As explained more fully hereinafter, first biasing means functions to urge swash plate 29 towards its first or maximum displacement position, whereas second biasing means 32 functions to urge the swash plate towards its second or minimum displacement position in opposition to the first biasing means and in response to the variable control pressure $P_C$ in chamber 24.

"Load-plus" valve 22 generally functions similar to the corresponding valve disclosed in above-referenced U.S. Pat. No. 4,116,587. Pump discharge pressure $P_D$ in a main discharge passage 41 communicates to chamber 38 of first biasing means 31 via a branch passage 42, an annulus 43, and a passage 44, whereas a second branch passage 45 communicates pump discharge pressure to first means 23 of load-plus valve 22. Branch passage 45 communicates a control pressure $P_C$ to a control chamber 46 via an annulus 47 and a restricted passage 48 formed in a tubular member secured in housing 30. Shortly after engine start-up, a spool 49 of first means 23 will move upwardly to the position shown to straddle and controllably modulate a passage 50 which communicates with chamber 24, by a land 51 defined on the spool.

Upon further increase of fluid pressure in chamber 46, spool 49 will move upwardly to a position communicating a passage 52 in the spool with chamber 24, via passage 50. As more fully described hereinafter, downward shifting of spool 49 from its position shown in FIG. 2 will communicate chamber 24 with a vent passage 53, via passage 50 and a second passage 54 defined in the spool. Second means 25 of load-plus valve 22 will control the position of spool 49 between a first position communicating pressurized fluid from chamber 46 to control chamber 24 and a second position at least partially venting control chamber 24 through passage 54, under certain operating conditions and in response to variations in load pressure $P_L$ in line 20.

In general, this invention is directed to an isolation means 55 which functions to improve the operation and physical makeup of load-plus valve 22. Isolation means 55 functions to isolate second means 25 from first means 23 to permit the first means to function independently of the second means in response to load pressure $P_L$ falling below a predetermined level. When the load pressure exceeds such level, isolation means 55 will function to permit mechanically interconnection of first and second means 23 and 25 to modulate control pressure $P_C$.

It should be noted in FIG. 2 that isolation means 55 may be considered to comprise the arrangement of first and second means 23 and 25 wherein they are physically separated during certain phases of operation of servo-system 22 and moved into physical contact with each other during other phases thereof. An upper end of spool 49 of first means 23 has an annular retainer 49' secured thereon and a stand-by pressure establishing means 56, shown in the form of a compression coil spring, is mounted between the retainer and housing 30. Thus, any upward movement of spool 49 in response to fluid pressure prevalent in chamber 46 will be counteracted by the biasing force of spring 56.

Second means 25 for controlling first means 23 to modulate control pressure $P_C$ in response to variations in load pressure $P_L$ includes a piston 57 reciprocally mounted in a tubular guide 58 forming part of housing 30 with an upper-flared end 57' of the piston being mounted in a cup-shaped and slotted retainer 59. A margin pressure establishing means 60, shown in the form of a second compression coil spring, is mounted between retainer 59 and housing 30 to provide a biasing and margin force opposing downward movement of piston 57 in FIG. 2 in response to increases in load pressure $P_L$. The load pressure is communicated to an actuating chamber 61 via line 20 and through a restricted orifice 62, defined in housing 30.

As described more fully hereinafter, when the fluid pressure in chamber 46 reaches a predetermined level, spool 49 will shift upwardly against the opposed biasing force of spring 56 towards a position S, substantially as illustrated, to alternately communicate control chamber 46 and vent passage 53 with chamber 24 to establish a stand-by pressure, primarily for establishing a pressure-flow potential for any implement motion in the fluid circuit and for makeing-up any leakage that may exist therein. Control pressure $P_C$ in chamber 24 will move piston 36 downwardly to pivot swash plate 29 towards its minimum displacement positon at or near stop 37. It should thus be noted that spring 56, which is independent of second means 25, provides a load-plus function in conjunction with margin spring 60 by exerting a substantially constant force on spool 49 whereby pump discharge pressure $P_D$ is always maintained above load pressure $P_L$, as indicated by the "MARGIN" in FIG. 3. Thus, pump discharge pressure is always above the load pressure and, once the pump discharge pressure exceeds a preselected minimum pressure level, the pressure differential between the pump discharge and load pressure will remain substantially constant throughout the higher pressure ranges.

Piston 57 of second means 25, which is responsive to load pressure $P_L$, is disposed for movement between its illustrated first position, isolating the piston from spool 49 of first means 23 to enable the spool to move independently of the piston, and a second position at S in FIG. 2 to engage and modulate movement of the spool under certain operating conditions.

FIG. 2 further illustrates a poppet-type relief valve 63 which establishes a maximum fluid pressure in the circuit. In particular, when such maximum fluid pressure is exceeded, the relief valve will open to communicate chamber 61 with a drain passage 64, via slotted retainer 59 and a passage 65. It should be further noted in FIG. 2 that the effective area of piston 36 is substantially larger than that of piston 35 whereby first biasing means 32 is enabled to overcome the opposing combined forces of first biasing means 31 to effect the desired control of the displacement of pump 11 between its minimum and maximum displacements. It will be appreciated by those skilled in the arts relating hereto that first and second biasing means 31 and 32 will have the various spring and related arrangements varied, depending on the particular design of the pump package. Also, swash plate 29 could be initially biased to its minimum displacement position (rather than its maximum displacement position illustrated in FIG. 2), depending on the particular application for the pump.

Industrial Applicability

Fluid circuit 10 finds particular application to hydraulic circuits for construction vehicles and the like wherein close and efficient control of one or more fluid actuators 13 is required for work purposes.

Referring to FIGS. 1 and 2, when the engine is shutdown with pump 11 inactivated, spring 56 will shift spool 49 downwardly to maintain control chamber 24 vented, via passages 50, 54 and 53. Upon starting-up of the engine to drive pump 11, spool 49 will initially shift upwardly to the position illustrated in FIG. 2 in response to communication of fluid pressure to chamber 46 from pump discharge 41, via passage 45, annulus 47, and passage 48. In this position of the spool, land 51 thereof will straddle passage 50 to throttle communication of chamber 46 with chamber 24. When a stand-by pressure, such as 6,895 kPa, is prevalent in main discharge passage 41, spool 49 will move up towards position S and continuously modulate between these two positions to maintain such stand-by pressure, which is set and controlled by spring 56 which functions independently of spring 60.

So long as no load pressure is generated in the circuit by cylinder 13, such as when directional control valve 14 is maintained in its neutral position illustrated in FIG. 1, spool 49 will continue to modulate to maintain a stand-by pressure of 6,895 kPa. Should it be desired to provide a "MARGIN" pressure of 1,379 kPa, for example, between pump discharge pressure $P_D$ and load pressure $P_L$ throughout the working range of the circuit above 6,895 kPa, springs 56 and 60 may be calibrated at 6,895 kPa and 5,516 kPa, respectively, to provide the same continuously. Therefore, when directional control valve is shifted from its FIG. 1 position to either extend or retract cylinder 13 under load, load pressure $P_L$ communicated to chamber 61 via line 20, will have no effect on maintaining such margin until the load pressure exceeds 5,516 kPa. When the fluid pressure level in chamber 61 exceeds 5,516 kPa to overcome the opposed biasing force of margin spring 60, piston 57 will move downwardly into physical contact with the upper end of spool 49.

Control pressure $P_C$ and load pressure $P_L$ are thus in direct opposition across the "solid" mechanical connection between the spool and piston. The direct opposition of these pressures will provide for close control of any modulation effected across land 51 of spool 49 when the spool is shifted downwardly by piston 57 to at least partially vent control chamber 24, via passages 50, 54, and 53. The reduced control pressure in chamber 24 will allow swash plate 27 to once again move towards its maximum displacement position illustrated in FIG. 2. Fluid pressure in chamber 46 will rise in a like amount since the displacement of pump 11 has increased to, in turn, increase discharge pressure $P_D$ whereafter swash plate 29 will again move towards its minimum or some intermediate displacement position, depending upon flow requirements. As stated above, relief valve 63 will function to prevent system pressures from exceeding a maximum pressure level.

Other aspects, objects, and advantages of this invention can be obtained from a study of the drawings, the disclosure, and the appended claims.

What is claimed is:

1. In a fluid circuit (10) having a fluid actuator (13), a variable displacement pump (11) including a control number (29) movable between first and second displacement positions, first biasing means (31) for urging said control member (29) towards its first displacement position, second biasing means (32) for urging said control member (29) towards its second displacement position in opposition to said first biasing means (31) and in response to a variable control pressure ($P_C$), first means (23) for varying said control pressure ($P_C$) in proportion to the discharge pressure ($P_D$) of said pump (11), and second means (25) for controlling said first means (23) to modulate said control pressure ($P_C$) in response to variations in a load pressure ($P_L$) received from said fluid actuator, the improvement comprising:

means (55) for mechanically isolating and separating said second means (25) from said first means (23), freeing said first means (23) to function independently of said second means (25) in response to said load pressure ($P_L$) falling below a predetermined level, and for mechanically interconnecting said first (23) and second (25) means to modulate said control pressure ($P_C$) by said second means (25) in response to said load pressure ($P_L$) exceeding said predetermined level.

2. The fluid circuit (10) of claim 1 wherein said second biasing means (32) includes a control chamber (24) adapted to have said control pressure ($P_C$) therein and said first means (23) includes spool means (49) for movement between a first position communicating said pump (11) with said control chamber (24) and a second position at least partially venting said control chamber (24).

3. The fluid circuit (10) of claim 2 wherein said second means (25) includes piston means (57) for movement between a first position whereat said piston means (57) is maintained in out-of-contact relationship with said spool means (49) by said isolation means (55) to enable said spool means (49) to move independently of said piston means (57), and a second position engaging and moving said spool means (49) in response to the differential fluid pressure between said load pressure ($P_L$) and said control pressure ($P_C$) exceeding a predetermined level.

4. The fluid circuit (10) of claim 3 wherein said first means (23) further includes stand-by pressure establishing means (56) for biasing said spool means (49) to maintain said pump discharge pressure ($P_D$) at a predetermined level when said piston means (57) is maintained in its first position.

5. The fluid circuit (10) of claim 4 further including margin pressure establishing means (60) for maintaining a predetermined margin of fluid pressure between said pump discharge pressure ($P_D$) and said load pressure ($P_L$) when said piston means (57) is at its second position engaging and moving said spool means (49) to modulate said control pressure ($P_C$).

6. The fluid circuit (10) of claim 5 wherein said stand-by pressure establishing means (56) includes a first compression coil spring (56) and said margin pressure establishing means (60) includes a second compression coil (60) spring mounted independently of said first compression coil spring (56).

7. A fluid circuit (10) comprising a source of pressurized fluid, including a variable displacement pump (11) having a control member (29) movable between first and second displacement positions, a fluid actuator (13) adapted to have a load pressure ($P_L$) therein, a directional control valve (14) interconnected between said pump (11) and said actuator (13), first biasing means (31) for urging said control member (29) towards its first displacement position, second biasing means (32) for urging said control member (29) towards its second displacement position in opposition to forces exerted by said first biasing means (31) and in response to a variable control pressure ($P_C$) adapted to be communicated to a control chamber (24) thereof, and a load-plus valve (22) including a housing (30), a spool (49) slidably disposed in said housing (30) and movable between a first position communicating pressurized fluid from said pump (11) to said control chamber (24) and a second position at least partially venting said control chamber (24), and a piston (57) slidably disposed in said housing (30) and movable between a first position mechanically isolating separating said piston (57) from said spool (49) to enable said spool (49) to move independently of said piston (57), and a second position mechanically engaging and moving said spool (49) in response to variations in said load pressure ($P_L$).

8. The fluid circuit (10) of claim 7 further including stand-by pressure establishing means (56) for biasing said spool (49) to maintain pump discharge pressure ($P_D$) at a predetermined level when said piston (57) is maintained in its first position.

9. The fluid circuit of claim 8 further including means (60) for maintaining a predetermined margin of fluid pressure between said pump discharge pressure ($P_D$) and said load pressure ($P_L$) when said piston means (57) is at its second position engaging said spool (49).

10. The fluid circuit (10) of claim 9 wherein said stand-by pressure establishing means (56) includes a first compression coil spring (56) and said margin pressure establishing means (60) includes a second compression coil spring (60) mounted independently of said first compression coil spring (56).

* * * * *